US009281622B2

(12) United States Patent
Fitzpatrick

(10) Patent No.: US 9,281,622 B2
(45) Date of Patent: Mar. 8, 2016

(54) COMMUNICATIONS JACKS HAVING LOW-COUPLING CONTACTS

(71) Applicant: CommScope, Inc. of North Carolina, Hickory, NC (US)

(72) Inventor: Brian J. Fitzpatrick, McKinney, TX (US)

(73) Assignee: CommScope, Inc. of North Carolina, Hickory, NC (US)

( * ) Notice: Subject to any disclaimer, the term of this patent is extended or adjusted under 35 U.S.C. 154(b) by 176 days.

(21) Appl. No.: 14/084,991

(22) Filed: Nov. 20, 2013

(65) Prior Publication Data

US 2014/0162477 A1 Jun. 12, 2014

Related U.S. Application Data

(60) Provisional application No. 61/734,412, filed on Dec. 7, 2012.

(51) Int. Cl.

| | |
|---|---|
| ***H01R 24/28*** | (2011.01) |
| ***H01R 13/6466*** | (2011.01) |
| *H01R 13/17* | (2006.01) |
| *H01R 24/64* | (2011.01) |

(52) U.S. Cl.

CPC ..... *H01R 13/6466* (2013.01); *H01R 13/17* (2013.01); *H01R 24/64* (2013.01)

(58) Field of Classification Search

CPC ..... H01R 23/025
USPC ..... 439/676, 188
See application file for complete search history.

(56) References Cited

U.S. PATENT DOCUMENTS

| | | | | |
|---|---|---|---|---|
| 4,469,389 | A | 9/1984 | Grabbe et al. | |
| 4,493,526 | A * | 1/1985 | Masuda | 439/668 |
| 5,975,919 | A * | 11/1999 | Arnett et al. | 439/82 |
| 6,079,996 | A * | 6/2000 | Arnett | H01R 24/64 200/51.06 |
| 6,156,981 | A * | 12/2000 | Ward | H01H 1/403 200/16 D |
| 6,305,960 | B1 * | 10/2001 | Fan | 439/188 |
| 6,350,158 | B1 * | 2/2002 | Arnett et al. | 439/676 |
| 6,371,780 | B1 * | 4/2002 | Aponte | H01R 13/7033 200/51.1 |
| 6,435,887 | B2 * | 8/2002 | Koitsalu | 200/51.1 |
| 6,491,534 | B1 * | 12/2002 | Bonard et al. | 439/188 |
| 6,641,443 | B1 | 11/2003 | Itano et al. | |
| 6,736,681 | B2 * | 5/2004 | Arnett | H05K 1/0228 439/676 |
| 6,786,776 | B2 | 9/2004 | Itano et al. | |
| 6,796,847 | B2 * | 9/2004 | AbuGhazaleh et al. | 439/676 |
| 6,918,778 | B2 * | 7/2005 | Ruckerbauer | H01R 12/85 200/51.1 |
| 7,172,444 | B1 * | 2/2007 | Huang | H01R 13/193 439/188 |
| 7,294,025 | B1 * | 11/2007 | Chen | 439/676 |
| 7,427,218 | B1 | 9/2008 | Hashim et al. | |
| 7,591,686 | B2 | 9/2009 | Ellis et al. | |

(Continued)

OTHER PUBLICATIONS

Combined Search and Examination Report for corresponding UK patent application No. GB1321533.0, dated Jun. 4, 2014, 5 pages.

*Primary Examiner* — Neil Abrams
(74) *Attorney, Agent, or Firm* — Myers Bigel & Sibley, P.A.

(57) ABSTRACT

Communications jacks include a housing having a plug aperture. A plurality of spring members extend into the plug aperture, and a plurality of plug contacts are mounted on respective ones of the spring members. The communications jack further includes a plurality of fixed contacts. Each fixed contact is configured to be in electrical contact with a respective one of the plug contacts when a plug is received within the plug aperture.

21 Claims, 4 Drawing Sheets

(56) References Cited

U.S. PATENT DOCUMENTS 7,722,370 B2 * 5/2010 Chin ..... 439/188
7,780,480 B2 * 8/2010 Caveney ..... H01R 13/6658 439/676
7,909,657 B1 * 3/2011 Abughazaleh ..... H05K 3/325 439/676
8,257,118 B2 * 9/2012 Bareel ..... H01R 13/6658 439/676
8,628,358 B2 * 1/2014 Tung ..... H01R 12/774 439/668
8,641,452 B2 * 2/2014 Patel et al. ..... 439/620.23
8,790,139 B2 * 7/2014 Fitzpatrick ..... 439/676
8,931,167 B2 * 1/2015 Abughazaleh ..... H05K 3/325 29/842
2002/0009930 A1 1/2002 Chang
2012/0244752 A1 9/2012 Patel et al.
2014/0162477 A1 * 6/2014 Fitzpatrick ..... 439/81

* cited by examiner

COMMUNICATIONS JACKS HAVING LOW-COUPLING CONTACTS

CROSS-REFERENCE TO RELATED APPLICATION

The present application claims priority under 35 U.S.C. §119 to U.S. Provisional Application Ser. No. 61/734,412, filed Dec. 7, 2012, the entire content of which is incorporated by reference herein as if set forth in its entirety.

FIELD OF THE INVENTION

The present invention relates generally to communications connectors and, more particularly, to communications jacks.

BACKGROUND

Computers, fax machines, printers and other electronic devices are routinely connected by communications cables to network equipment such as routers, switches, servers and the like. FIG. 1 illustrates the manner in which a computer 10 may be connected to a network device 30 (e.g., a network switch) using conventional communications plug/jack connections. As shown in FIG. 1, the computer 10 is connected by a patch cord 11 to a communications jack 20 that is mounted in a wall plate 18. The patch cord 11 comprises a communications cable 12 that contains a plurality of individual conductors (e.g., eight insulated copper wires) and first and second communications plugs 13, 14 that are attached to the respective ends of the cable 12. The first communications plug 13 is inserted into a plug aperture of a communications jack (not shown) that is provided in the computer 10, and the second communications plug 14 is inserted into a plug aperture 22 in the front side of the communications jack 20. The contacts or "blades" of the second communications plug 14 are exposed through the slots 15 on the top and front surfaces of the second communications plug 14 and mate with respective "jackwire" contacts of the communications jack 20. The blades of the first communications plug 13 similarly mate with respective jackwire contacts of the communications jack (not shown) that is provided in the computer 10.

The communications jack 20 includes a back-end wire connection assembly 24 that receives and holds insulated conductors from a cable 26. As shown in FIG. 1, each conductor of cable 26 is individually pressed into a respective one of a plurality of slots provided in the back-end wire connection assembly 24 to establish mechanical and electrical connection between each conductor of cable 26 and a respective one of a plurality of conductive paths (not shown in FIG. 1) through the communications jack 20. The other end of each conductor in cable 26 may be connected to, for example, the network device 30. The wall plate 18 is typically mounted on a wall (not shown) of a room of, for example, an office building, and the cable 26 typically runs through conduits in the walls and/or ceilings of the office building to a room in which the network device 30 is located. The patch cord 11, the communications jack 20 and the cable 26 provide a plurality of signal transmission paths over which information signals may be communicated between the computer 10 and the network device 30. It will be appreciated that typically one or more patch panels, along with additional communications cabling, would be included in the communications path between the cable 26 and the network device 30. However, for ease of description, in FIG. 1 the cable 26 is shown as being directly connected to the network device 30.

In the above-described communications system, the information signals that are transmitted between the computer 10 and the network device 30 are typically transmitted over a pair of conductors (hereinafter a "differential pair" or simply a "pair") rather than over a single conductor. An information signal is transmitted over a differential pair by transmitting signals on each conductor of the pair that have equal magnitudes, but opposite phases, where the signals transmitted on the two conductors of the pair are selected such that the information signal is the voltage difference between the two transmitted signals. The use of differential signaling can greatly reduce the impact of noise on the information signal.

Various industry standards, such as the TIA/EIA-568-C.2 standard approved in August 2009 by the Telecommunications Industry Association, have been promulgated that specify configurations, interfaces, performance levels and the like that help ensure that jacks, plugs and cables that are produced by different manufacturers will all work together. By way of example, the TIA/EIA-568-C.2 standard is designed to ensure that plugs, jacks and cable segments that comply with the standard will provide certain minimum levels of performance for signals transmitted at frequencies of up to 250 MHz. Most of these industry standards specify that each jack, plug and cable segment in a communications system must include a total of eight conductors 1-8 that are arranged as four differential pairs of conductors. The industry standards specify that, in at least the connection region where the contacts (blades) of a plug mate with the jackwire contacts of the jack (referred to herein as the "plug-jack mating region"), the eight conductors are generally aligned in a row. As shown in FIG. 2, under the TIA/EIA 568 type B configuration (which is the most widely followed), conductors 4 and 5 comprise differential pair 1, conductors 1 and 2 comprise differential pair 2, conductors 3 and 6 comprise differential pair 3, and conductors 7 and 8 comprise differential pair 4.

Unfortunately, the industry-standardized configuration for the plug-jack mating region that is shown in FIG. 2, which was adopted many years ago, generates a type of noise known as "crosstalk." As is known to those of skill in this art, "crosstalk" refers to unwanted signal energy that is induced onto the conductors of a first "victim" differential pair from a signal that is transmitted over a second "disturbing" differential pair. Various techniques have been developed for cancelling out the crosstalk that arises in industry standardized plugs and jacks. Many of these techniques involve providing crosstalk compensation circuits in each communications jack that introduce "compensating" crosstalk that cancels out much of the "offending" crosstalk that is introduced in the plug and the plug-jack mating region due to the industry-standardized plug-jack interface. In order to achieve high levels of crosstalk cancellation, the industry standards specify pre-defined ranges for the crosstalk that is injected between the four differential pairs in each communication plug, which allows each manufacturer to, design the crosstalk compensation circuits in their communications jacks to cancel out these pre-defined amounts of crosstalk. Typically, the communications jacks use "multi-stage" crosstalk compensation circuits as disclosed, for example, in U.S. Pat. No. 5,997,358 to Adriaenssens et al. (hereinafter "the '358 patent"), as multi-stage crosstalk compensating schemes can provide significantly improved crosstalk cancellation, particularly at higher frequencies. The entire contents of the '358 patent are hereby incorporated herein by reference as if set forth fully herein.

SUMMARY

Pursuant to embodiments of the present invention, communications jacks are provided that include a housing having a plug aperture. A plurality of spring members extend into the plug aperture, and a plurality of plug contacts are mounted on respective ones of the spring members. The jack further includes a plurality of fixed contacts. Each fixed contact is configured to be in electrical contact with a respective one of the plug contacts when a plug is received within the plug aperture.

In some embodiments, the jacks may include a printed circuit board that is mounted at least partly within the housing. Each of the fixed contacts may be mounted in or on the printed circuit board. In some embodiments, each of the fixed contacts may include a base portion that is mounted in an opening in the printed circuit board and at least one protruding member that extends above a top surface of the printed circuit board. The fixed contacts may have an eye-of-the-needle termination that is mounted in a respective one of a plurality of apertures in the printed circuit board. In other embodiments, each of the fixed contacts may comprise an aperture in the printed circuit board that has a sidewall that is at least partly covered with a conductive material, and each of the plug contacts may include a downwardly extending member that engages the conductive material on the sidewall of the aperture.

In some embodiments, each of the spring members may comprise an elongated member formed of a resilient metal that is at least partly coated with an insulative material. In some embodiments, at least some of the spring members may be mounted so as to inject a compensating crosstalk signal on at least one of a plurality of differential pairs of communications channels that run through the communications jack. In other embodiments, the spring members may be formed of an insulative material.

Each of the plug contacts may include at least one downwardly extending member that is configured to slide along a respective one of the fixed contacts in order to maintain a mechanical and electrical connection to the fixed contact. Each of the plug contacts may have the same shape, and at least one of the plug contacts may be mounted in an orientation that is about 180 degrees rotated from the orientation of another of the plug contacts. In some embodiments, each plug contact may include a pair of downwardly extending flanges. The downwardly extending flanges of a first of the plug contacts may be offset in a longitudinal direction of the jack from the downwardly extending flanges of a second plug contact that is directly adjacent to the first plug contact. Each plug contact may be a resilient metal contact.

The jack may also include a plurality of conductive paths on the printed circuit board, each of which is electrically connected to a respective one of the fixed contacts. A plurality of output contact mounting structures may be provided on or in the printed circuit board that are electrically connected to respective ones of the conductive paths on the printed circuit board.

The communications jack may further include a spring holder that is mounted on the printed circuit board that mounts the spring members to extend in cantilever fashion above a top surface of the printed circuit board. Each spring member may be electrically isolated from the respective one of the plug contacts mounted thereon by an insulating material that is coated on the spring member.

In some embodiments, a first of the fixed contacts may have first and second members that protrude above the printed circuit board that are in selective electrical contact with a first of the plug contacts. In such embodiments, the first member may be part of a signal current carrying path between the first of the plug contacts and an output of the jack, and the second member may electrically connect a crosstalk compensation circuit to the first of the plug contacts.

Pursuant to further embodiments of the present invention, communications jacks are provided that include a housing having a plug aperture, a spring member that extends into the plug aperture, and a conductive plug contact that is separate from the spring member that is mounted on the spring member to move upwardly and downwardly with the spring member relative to the housing.

In some embodiments, the conductive plug contact may have an upper surface that is configured to engage the blade of a mating plug and at least one downwardly extending flange. These jacks may further include a printed circuit board that is at least partly mounted within the housing underneath the spring member. A printed circuit board mounted contact may be mounted on the printed circuit board and may be configured to be mate with the conductive plug contact. In some embodiments, the spring member may be electrically isolated from the conductive plug contact. In some embodiments, the conductive plug contact may be a sliding contact that is configured to slide along a surface of the printed circuit board mounted contact.

DETAILED DESCRIPTION

Figure 1:
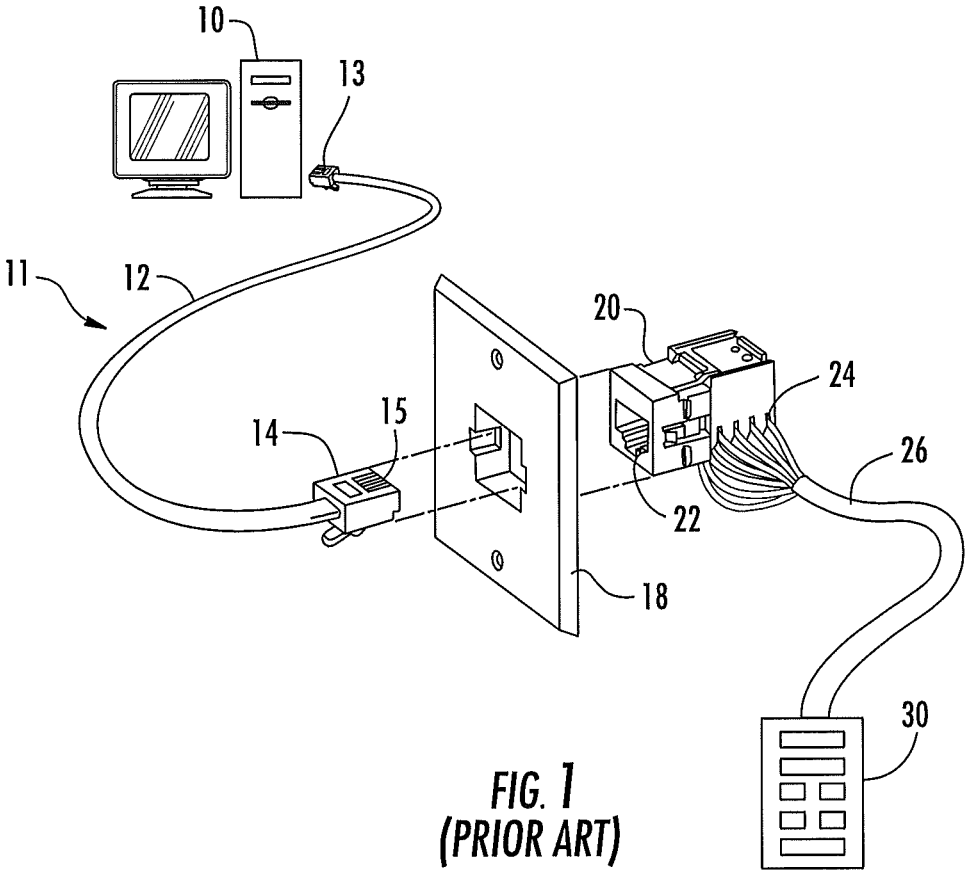
FIG. 1 (PRIOR ART)
FIG. 1 is a schematic drawing that illustrates the use of communications plug-jack connectors to connect a computer to a network device.
Figure 2:
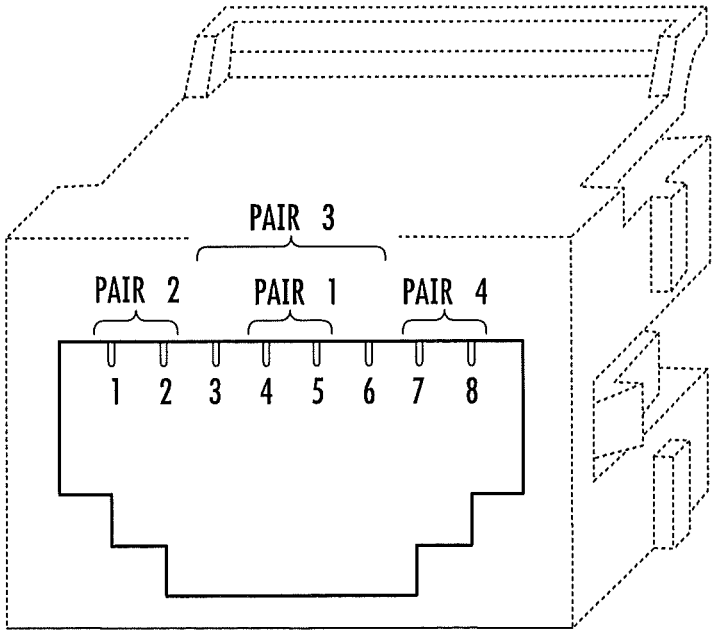
FIG. 2 (PRIOR ART)
FIG. 2 is a schematic diagram illustrating the modular jack contact wiring assignments for a conventional 8-position communications jack (TIA 568B) as viewed from the front opening of the jack.

Pursuant to embodiments of the present invention, communications jacks are provided that have plug contacts with very short current paths as compared to most conventional communications jacks (herein the term "current path" refers to the physical distance a signal travels along a structure such as a plug contact when passing through the structure). The current paths through the plug contacts of these jacks may be shortened because, for example, the jacks may use separate springs that are not part of the current path to provide the requisite contact force as opposed to using conventional jack-wire contacts that are sufficiently elongated such that they resiliently deflect to provide the requisite contact force when the jack is mated with a communications plug. By shortening the current path through the plug contacts, the coupling between adjacent plug contacts may be advantageously reduced. Additionally, since the jacks according to embodiments of the present invention may have very short current paths through the plug contacts, it is typically possible to provide crosstalk compensating structures on a printed circuit board of the jack that are located such that they are at a small delay from the plug jack mating point. This may reduce the amount of offending crosstalk that is injected in a mated plug-jack combination, and also may allow for the compensating crosstalk to more effectively cancel out the offending crosstalk. The jacks may comprise, for example, RJ-45 or RJ-11 jacks, although embodiments of the present invention are not limited thereto. Herein, a "plug contact" of a jack refers to a contact of the jack that is configured to mate with a blade (or other contact structure) of a plug that is received within the plug aperture of the jack.

In some embodiments, the plug contacts may be sliding contacts that are mounted on one or more spring members. When a mating plug is inserted into the plug aperture of the jack, each of the spring members (along with the plug contacts mounted thereon) may be deflected downwardly. As the plug contacts are pressed downward, they each slide along a respective one of a plurality of fixed contacts that are mounted, for example, on a printed circuit board. Each blade of the mating plug mates with a respective one of the plug contacts so that signals may pass from the plug blade to the printed circuit board by passing first to the plug contact, then to the fixed contact, and finally to conductive structures of the printed circuit board.

In some embodiments, the spring members may comprise elongated members that are formed of a resilient metal that are coated with an insulating material. Each plug contact may be mounted on a respective one of the spring members. The elongated spring members may be mounted in a cantilevered fashion to extend into the plug aperture. Each plug contact may include one or more downwardly extending flanges. The fixed contacts may be mounted in the printed circuit board underneath the downwardly extending flanges of the plug contacts such that the downwardly extending flanges contact respective ones of the fixed contacts. As the spring members and plug contacts are deflected downwardly, the downwardly extending flanges of each plug contact slide downwardly along their respective fixed contact, maintaining electrical contact therewith. The plug contacts may be mounted in opposite directions on every other spring member in order to reduce crosstalk between adjacent plug contacts and/or between adjacent fixed contacts. Additionally, the spring members may also be staggered in the longitudinal direction of the jack in order to further reduce coupling between adjacent plug contacts and/or fixed contacts. The communications jacks according to embodiments of the present invention may exhibit outstanding crosstalk performance.

Embodiments of the present invention will now be described with reference to the accompanying drawings, in which exemplary embodiments are shown.

Figure 3A:
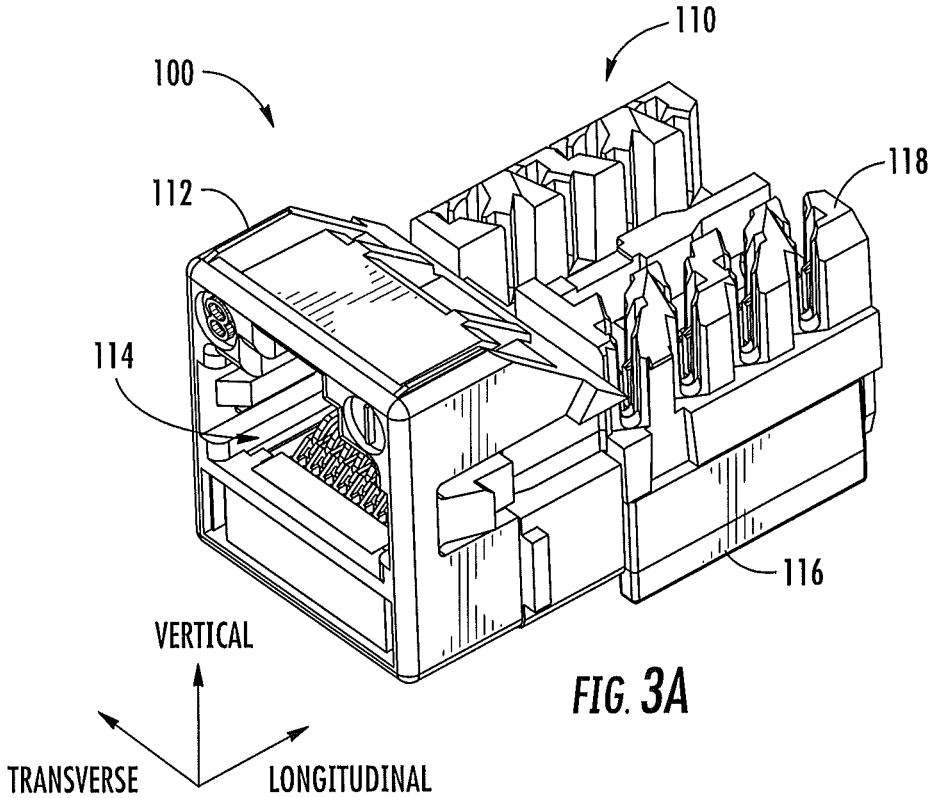
FIGS. 3A-3E illustrate a communications jack according to embodiments of the present invention.
Figure 3B:
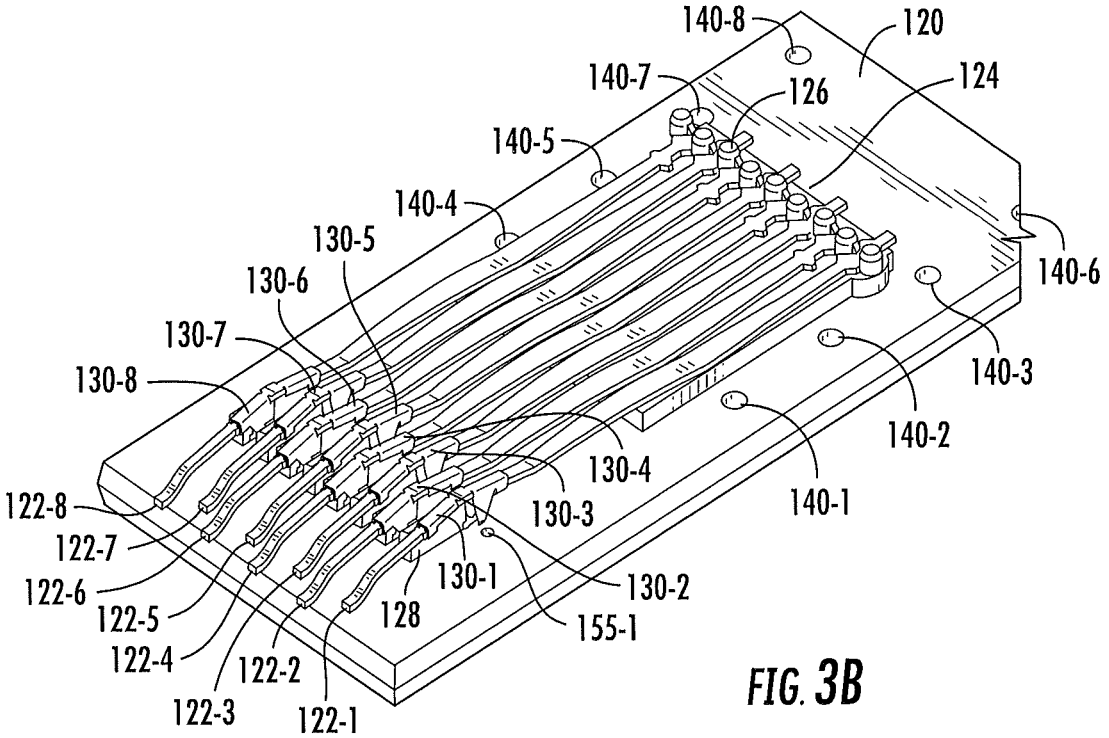
Figure 3C:
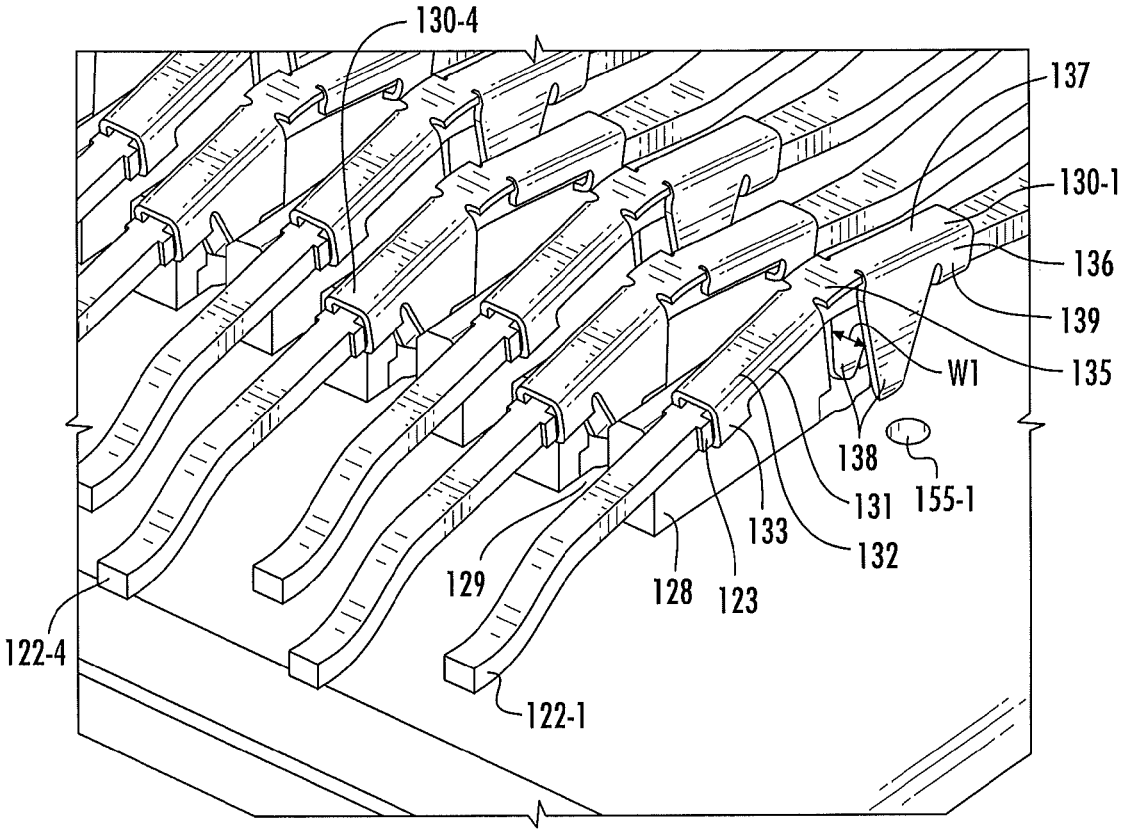
Figure 3D:
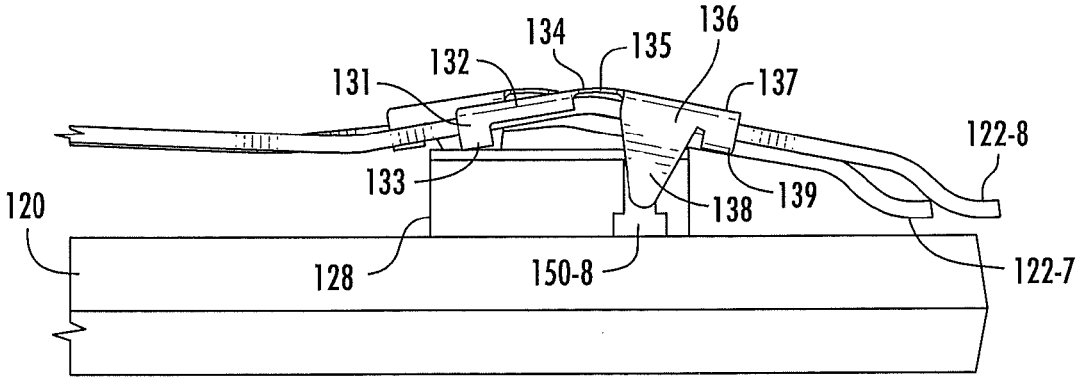
Figure 3E:
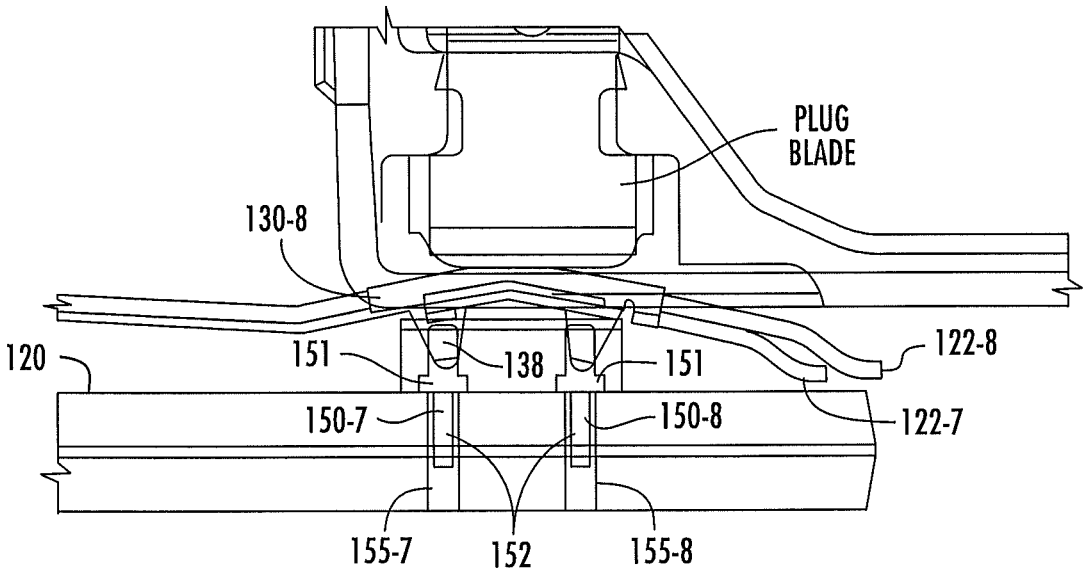

FIGS. 3A-3E illustrate a communications jack 100 according to embodiments of the present invention. In particular, FIG. 3A is a perspective view of the communications jack 100. FIG. 3B is a schematic perspective view of a printed circuit board 120 of the jack 100 with the spring members ("springs") 122 and plug contacts 130 of the jack 100 mounted thereon. FIG. 3C is an enlarged perspective view of a front portion of the printed circuit board 120 that better illustrates how the plug contacts 130 are mounted on the springs 122. FIG. 3D is a side view of the front portion of the printed circuit board 120. FIG. 3E is schematic cross-sectional view of the front portion of the printed circuit board 120 (taken along spring 122-7 of FIG. 3B) that illustrates how the fixed contacts of the jack 100 are mounted in the printed circuit board 120 and that further illustrates a plug blade engaging one of the plug contacts 130.

As shown in FIG. 3A, the jack 100 includes a housing 110 that includes a jack frame 112, a cover 116 and a terminal housing 118. The jack frame 112 includes a plug aperture 114 for receiving a mating plug. The housing components 112, 116, 118 may be conventionally formed and need not be described in detail herein. Those skilled in this art will recognize that other configurations of jack frames, covers and terminal housings may also be employed with the present invention, and that the housing 110 may have more or less than three pieces. It will also be appreciated that, when mounted, the jack 100 is typically rotated 180 degrees about its longitudinal axis from the orientation shown in FIG. 3A so that the plug contacts 130 of the jack 100 extend downwardly from the top of the plug aperture 114. In the discussion that follows, the relationship of the components of jack 100 with respect to each other will be described with respect to the orientation of FIG. 3A for convenience, but it will be appreciated that in use the jack 100 will more commonly be turned upside down from the orientation shown in FIG. 3A.

FIG. 3B is a schematic perspective view of a printed circuit board 120 that is included in the jack 100. The printed circuit board 120 is received within an opening in the rear of the jack frame 112. The bottom of the printed circuit board 120 is protected by the cover 116, and the top of the printed circuit board 120 is covered and protected by the terminal housing 118. As shown in FIG. 3B, a plurality of elongated springs 122-1 through 122-8 are mounted on the printed circuit board 120. Herein, when the communications jacks according to embodiments of the present invention include multiple of the same components, these components may be referred to individually by their full reference numerals (e.g., spring 122-4) and may be referred to collectively by the first part of their reference numeral (e.g., the springs 122). In the depicted embodiment, the springs 122-1 through 122-8 are mounted to the top surface of the printed circuit board 120. However, it will be appreciated that in other embodiments the springs 122 may be mounted to other structures, such as one of the pieces of the housing 110. Moreover, while the depicted embodiment includes eight separate springs 122-1 through 122-8, it will be appreciated that fewer springs may be used. For example, in another embodiment a single spring 122 may be used that has a comb-like structure consisting of a base and eight elongated fingers that extend from the base that act as eight spring members. Other spring configurations may also be used.

In the illustrated embodiment, each spring 122 comprises an elongated strip of resilient metal that is coated with an insulative coating. For example, each spring 122 may comprise a beryllium-copper or phosphor-bronze strip or wire that is coated with an insulative material such as a plastic coating. In other embodiments, the springs 122 may be insulative springs that are formed, for example, of plastic. A spring holder 124 is bonded or otherwise attached to the top surface of the printed circuit board 120. The spring holder 124 includes a plurality of raised structures 126. The base end of each spring 122 is configured to be received between adjacent ones of the raised structures 126 in order to hold each spring 122 in place. The spring holder 124 also holds each spring 122 above the top surface of the printed circuit board 120 so that each spring 122 may be depressed downwardly when a mating plug is received within the plug aperture 114 of the jack 100.

A plurality of insulative guide walls 128 are also mounted on the top surface of the printed circuit board 120 that define a plurality of guiding slots 129 therebetween. The guide walls 128 may be used to keep the springs 122-1 through 122-8 in proper transverse alignment. In the illustrated embodiment, each guiding wall 128 comprises a plastic wall that protrudes upwardly from a top surface of the printed circuit board 120. In the depicted embodiment, a total of seven guide walls 128 are provided that are transversely aligned in a row. Side walls of the jack frame 112 may act as the second guide wall for springs 122-1 and 122-8 or, alternatively, two additional guide walls 128 may be provided on either end of the row of guide walls 128. Springs 122-2 through 122-7 are each interposed between two adjacent guide walls 128, which serve to keep the springs 122-2 through 122-7 in proper transverse alignment as they move up and down in response to plugs being inserted into, and removed from, the plug aperture 114 in order to maintain the springs 122 (and the plug contacts 130 that are mounted thereon, as explained below) at desired distances from each other and to ensure that the plug contacts 130 are properly aligned with their mating plug blades.

A plurality of metal-plated apertures 140-1 through 140-8 are provided in two rows along the back portion of the printed circuit board 120. Each of the apertures 140 may receive a respective one of a plurality of output terminals (not shown). The output terminals (not shown) that are received in the apertures 140-1 through 140-8 may comprise, for example, conventional insulation displacement contacts ("IDC") that are soldered or press fit into the apertures 140-1 through 140-8 such as, for example, the IDCs disclosed in the aforementioned '358 patent. As is well known to those of skill in the art, an IDC is a type of wire connection terminal that may be used to make mechanical and electrical connection to an insulated wire conductor. The IDCs may be of conventional construction and need not be described in detail herein. Any other appropriate output contact may be used including, for example, insulation piercing contacts or conductive pads or other conductive structures that the wires of a communications cable may be attached or connected to.

A plurality of plug contacts 130-1 through 130-8 are mounted on the respective springs 122-1 through 122-8. As shown best in FIGS. 3B though 3D, eight plug contacts 130-1 through 130-8 are mounted in a row on respective ones of the springs 122-1 through 122-8. As shown in FIGS. 3C and 3D, each plug contact 130 includes a front section. 131, a rear section 136 and a central section 134 that connects the front section 131 to the rear section 136. The front section 131 of each plug contact 130 includes an upper plate 132 and prongs 133 that are bent around its associated spring 122 to mount the front section 131 onto the spring 122. The rear section 136 includes an upper plate 137, a pair of downwardly extending flanges 138 and prongs 139 that extend around its associated spring 122 to mount the rear section 136 of the plug contact 130 onto its associated spring 122. The central section 134 comprises an upper plate 135 that connects the upper plate 132 of the front section 131 to the upper plate 137 of the rear section 136. The upper plates 132, 135, 137 together comprise a plug blade contact surface, as it is these upper plates 132, 135, 137 that engage a blade of a mating plug when the mating plug is inserted in the plug aperture 114 of communications jack 100. The downwardly extending flanges 138 may extend below the bottom surface of the spring 122. As a result, the spring 122 may deflect downwardly some distance before a top surface of fixed contact 150 (discussed below) contacts the bottom surface of its associated spring 122, while ensuring that the downwardly extending flanges 138 maintain contact with the fixed contact 150.

As shown in FIGS. 3D and 3E, a plurality of fixed contacts 150-1 through 150-8 are provided on the printed circuit board 120. Note that the outermost fixed contacts 150 are omitted from FIGS. 3B and 3C in order to better illustrate the configuration of the plug contacts 130. As shown in FIGS. 3D and 3E, each fixed contact 150 may include a column portion 151 that protrudes vertically above the top surface of the printed circuit board 120 and a termination portion 152 that extends into the printed circuit board 120. In the depicted embodiment, the column portion 151 comprises a relatively thin, elongated column having planar sidewalls that are configured to mate with the downwardly extending flanges 138 of a respective one of the plug contacts 130. The termination portion 152 comprises a solder post that is received within a metal plated aperture 155 in the printed circuit board 120, but any other appropriate termination may be used such as, for example, an eye-of-the-needle termination. A representative one of these metal plated apertures is depicted in FIGS. 3B and 3C (namely metal-plated aperture 155-1) that is positioned underneath the pair of downwardly extending flanges 138 on plug contact 130-1. Apertures 155-7 and 155-8 are visible in FIG. 3E. The other metal-plated apertures 155-2 through 155-6 are positioned underneath the downwardly extending flanges 138 on plug contacts 130-2 through 130-6, respectively. The metal-plated apertures 155-1 through 155-8 may be electrically connected to conductive paths that are provided through the printed circuit board 120 that electrically connect each plug contact 130 to a respective one of the metal plated aperture 140 that hold the respective output terminals of the jack 100 (see discussion below).

Each fixed contact 150 may be formed of a conductive material such as, for example, copper, a copper alloy, or a plated copper or copper alloy (e.g., copper plated with gold or nickel). As noted above, the plug contacts 130 may be formed of a resilient metal such as beryllium-copper or phosphor-bronze. The inner walls of the downwardly extending flanges 138 may be separated by a first minimum distance W1 (see FIG. 3C) when in their normal resting position. The transverse width of the fixed contact 150 may exceed the width W1 such that the downwardly extending flanges 138 of each plug contact 130 must be pulled apart slightly during the assembly process in order to mount the flanges 138 of each plug contact 130 on either side of its respective fixed contact 150. As a result of this configuration, the resilient nature of the downwardly extending flanges 138 presses each downwardly extending flange 138 against the fixed contact 150 so that a good mechanical and electrical connection is maintained between each plug contact 130 and the column portion 151 of its respective fixed contact 150. The column portion 151 of each fixed contact 150 may be any appropriate height.

Figure 4:
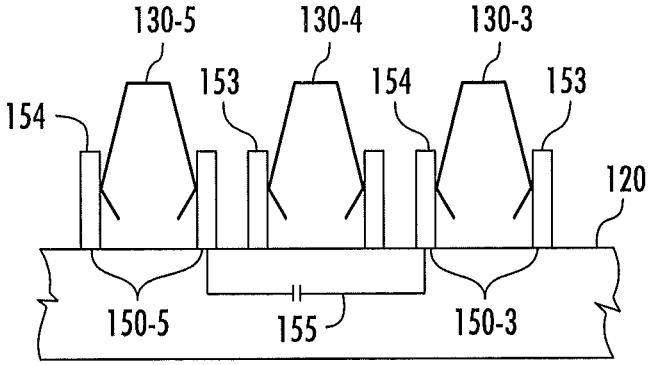
FIG. 4 is a schematic view of contact structures included in a communications jack according to further embodiments of the present invention.

While the fixed contacts 150 are implemented as protruding columns that extend upwardly from the printed circuit board 120 in the embodiment of FIGS. 3A-3E, it will be appreciated that a wide variety of other fixed contacts 150 may be used. For example, FIG. 4 illustrates a portion of a communications jack according to further embodiments of the present invention that includes an alternative fixed contact 150' (only three of the eight fixed contacts 150' and their associated plug contacts 130 are shown in FIG. 4 to simplify the drawing). As shown in FIG. 4, each fixed contact 150' includes a pair of thin plates 153, 154 that protrude upwardly from the printed circuit board 120. As illustrated in FIG. 4, in this embodiment, the downwardly extending flanges 138 of the plug contact 130 may slide up and down along the inner (facing) surfaces of the two upwardly extending plates 153, 154 of their associated fixed contact 150'. The remainder of the alternative jack is not further depicted or described herein as the remaining components of this jack may be identical to the components of jack 100.

The fixed contacts 150' that are illustrated in FIG. 4 allow for two separate electrical paths onto the printed circuit board 120 for each plug contact 130, namely a first path through plate 153 and a second path through plate 154. As a result, the first path may be used as a signal current carrying path that passes the signal current from the printed circuit board 120 to the plug contact 130, while the second path may be used to introduce very low delay crosstalk compensation. By way of example, a capacitor 155 may be implemented on the printed circuit board 120. A first electrode of this capacitor 155 may be connected by one or more traces to the plate 154 of fixed contact 150'-3, while the second electrode of this capacitor 155 may be connected by one or more traces to the plate 154 of fixed contact 150'-5. In this manner, a crosstalk compensation circuit may be implemented between conductive paths 3 and 5 that injects compensating crosstalk that may be used to cancel out crosstalk that arises between blades 3 and 4 in the mating communications plug. As the capacitor 155 is not part of the signal current carrying path for either conductors 3 or 5, it will appear as being at a very small delay from the plug-jack mating point. As discussed above, crosstalk compensation may be more effective when injected at a small delay.

It will be appreciated that either or both the fixed contacts 150' and the plug contacts 130 may be formed of a resilient metal. For example, in another embodiment, the plug contacts 130 may be formed of a non-resilient metal (e.g., copper or gold-plated copper) and the fixed contacts 150' may be formed of a resilient metal.

In yet another embodiment, the fixed contact may comprise a metal-plated opening 150" in the printed circuit board 120. Metal-plated aperture 155-1 of FIG. 3C could serve as such a fixed contact 150". The downwardly extending flanges 138 on the plug contact 130 may extend into this opening 150" and be designed to contact sidewalls of the opening 150". Such an embodiment may have an even shorter current path through the plug contact 130 as the spring 122 may be mounted very close to the top surface of the printed circuit board 120 in such an embodiment.

As shown best in FIG. 3C, each spring 122 may include one or more stops 123 that maintain the plug contacts 130 in their proper position along the spring 122. In the illustrated embodiment, the stop 123 comprises a region of the spring 122 that has an expanded width in the transverse direction. In FIG. 3C, the stop 123 is located along the spring 122 directly forward of the plug contact 130 so as to prevent the plug contact 130 from sliding forwardly along the spring 122. While not shown in FIG. 3C, a second stop 123 may be provided along the spring 122 immediately rearward of the plug contact 130 that prevents the plug contact 130 from sliding rearwardly along the spring 122. It will also be appreciated that the stop 123 illustrated in FIG. 3C is exemplary in nature, and that any appropriate stop or group of stops may be used. It will also be appreciated that the stops may be omitted in some embodiments. For example, in some embodiment, the prongs 133, 139 may be used to firmly mount a plug contact 130 onto its respective spring 122, thereby eliminating any need for a stop 123.

The printed circuit board 120 may comprise any conventional printed circuit board, and may be a single layer or printed circuit board having conductive structures on both sides thereof, or may comprise a multi-layer structure that includes conductive structures on interior layers of the printed circuit board 120. The printed circuit board 120 may be used as a transmission medium for signals that pass between the plug contacts 130 and the output terminals that are mounted in the apertures 140. In particular, the printed circuit board 120 may include a plurality of conductive paths (not shown), where each path electrically connects one of the plug contacts 130 to a respective one of the apertures 140 that hold the output terminals of jack 100. Each conductive path may be formed, for example, as a unitary conductive trace that resides on a single layer of the printed circuit board 120 or as two or more conductive traces that are provided on multiple layers of the printed circuit board 120 and which are electrically connected through metal-filled vias or other layer transferring techniques known to those of skill in the art. The conductive traces may be formed of conventional conductive materials such as, for example, copper, and are deposited on the printed circuit board 120 via any deposition method known to those skilled in this art.

A plurality of crosstalk compensation circuits such as, for example, interdigitated finger capacitors, plate capacitors, inductively coupling trace sections and the like may also be provided on and/or within the printed circuit board 120. Various exemplary crosstalk compensation structures are disclosed in the above referenced '358 patent. In some embodiments, at least some of these crosstalk compensation circuits may be positioned to create a very short delay from the plug contacts 130. For example, crosstalk compensation capacitors may be provided on the printed circuit board 120 that are attached to the metal-plated apertures 155 that receive the fixed contacts 150. By way of example, a plate capacitor may be formed on the printed circuit board 120 where a first plate of the capacitor is connected to the metal-plated aperture 155-3 and the second plate of the capacitor is connected to the metal-plated aperture 155-5 to provide crosstalk compensation between pairs 1 and 3. Similarly, a plate capacitor may additionally or alternatively be formed on the printed circuit board 120 where a first plate of the capacitor is connected to the metal-plated aperture 155-4 and the second plate of the capacitor is connected to the metal-plated aperture 155-6 to provide crosstalk compensation between pairs 1 and 3. Given the short current paths through the plug contacts 130 and fixed contacts 150 onto the printed circuit board 120, these crosstalk compensation capacitors may inject crosstalk compensation at a very small delay, and hence may provide very effective crosstalk compensation. It will be appreciated that a number of such crosstalk compensation circuits may be included on or in the printed circuit board 120, and that these circuits may be inductive and/or capacitive in nature and may be between any appropriate conductive paths. It will also be appreciated that these crosstalk compensation circuits may be designed to perform single-stage and/or multi-stage crosstalk compensation.

In some embodiments various techniques may be used to further reduce coupling between adjacent plug contacts 130 and/or to increase coupling between non-adjacent plug contacts 130 (as such increased coupling may serve as compensating crosstalk). For example, as shown best in FIG. 3C, every other plug contact (here plug contacts 130-2, 130-4, 130-6 and 130-8) may be mounted on its respective spring 122 backwards, so that the downwardly extending flanges 138 on adjacent plug contacts 130 are not aligned along the transverse direction. As the downwardly extending flanges 138 of two adjacent plug contacts 130 may, in effect, act like a capacitor, mounting every other plug contact 130 backwards on its spring 122 may significantly decrease the amount of capacitive coupling that occurs between adjacent plug contacts 130. Moreover, as the downwardly extending flanges 138 remain transversely aligned with respect to every other plug contact 130 (e.g., the downwardly extending flanges of contacts 130-1, 130-3, 130-5 and 130-7 remain transversely aligned), the capacitive coupling between these plug contacts 130 may, in effect, introduce compensating crosstalk at a very short delay from the location where signals pass between the jack and a mating plug.

As is further shown in FIGS. 3B and 3C, the base of each spring 122 has two possible mounting positions on the spring holder 124. Springs 122-1, 122-3, 122-5 and 122-7 are each mounted in the first mounting position, while springs 122-2, 122-4, 122-6 and 122-8 are each mounted in the second mounting position, and hence extend farther forward along printed circuit board 120. By offsetting the springs 122 longitudinally in this fashion, the amount of transverse overlap between adjacent plug contacts 130 may be further reduced, thereby further decreasing the amount of crosstalk that arises between adjacent plug contacts 130 and/or facilitate the introduction of compensating crosstalk in the plug contacts.

While the above examples illustrate example ways in which the amount of crosstalk may be reduced, it will be appreciated that many other techniques may be used. For example, while in the above embodiments all of the springs 122 and all of the plug contacts 130 are identical to each other (which simplifies manufacturing), in other embodiments, different spring designs and/or plug contact designs could be used that further reduce coupling between adjacent plug contacts 130.

The communications jacks described above may exhibit improved performance as compared to many conventional communications jacks. Most conventional RJ-45 communications jacks implement the plug contacts using spring jackwires that are elongated contact wires that are formed of beryllium-copper or phosphor-bronze. These contact wires may be formed to be sufficiently resilient such that the plug contact will meet industry standardized specifications with respect to the contact force that each plug contact applies to a mating plug blade and/or to ensure that the contact wires do not become permanently deformed with use. Typically, relatively long contact wires must be used in order to ensure that the contact wire provides the requisite contact force. In contrast, the plug contacts 130 (and fixed contacts 150) that are used in embodiments of the present invention may be much shorter and thus the current path through each of the plug contacts 130 may be very short in length. In some embodiments, the length of the current path from the point where each plug blade engages its respective plug contact to the printed circuit board 120 may be on the order of about 80 mils to about 120 mils, which is far less than the current path through most conventional spring jackwire contacts. As a result of this very short current path, it is possible to inject either capacitive and/or inductive crosstalk compensation on the printed circuit board 120 at a point that is very close in time to the plug-jack mating point, which may result in more effective crosstalk cancellation. Moreover, as noted above, in some embodiments two conductive paths may be provided to the printed circuit board for at least some of the plug contacts 130 so that very low delay capacitive crosstalk compensation can be injected between differential pairs using capacitors implemented in the printed circuit board 120. The plug contacts 130 may also be arranged so that compensating inductive and/or capacitive crosstalk is injected between different differential pairs in the plug contacts 130. This may be accomplished, for example, by the staggered arrangement of the fixed contacts 150 on the printed circuit board 120 which may allow the plug contacts 130 and/or fixed contacts 150 to couple more heavily with non-adjacent plug contacts 130 and fixed contacts 150 than they do with adjacent plug contacts 130 and fixed contacts 150.

While embodiments of the present invention have primarily been discussed herein with respect to communications jacks that include eight conductive paths that are arranged as four differential pairs of conductive paths, it will be appreciated that the concepts described herein are equally applicable to jacks that include other numbers of differential pairs. It will also be appreciated that communications cables and connectors may sometimes include additional conductive paths that are used for other purposes such as, for example, providing intelligent patching capabilities. The concepts described herein are equally applicable for use with such communications cables and connectors, and the addition of one or more conductive paths for providing such intelligent patching capabilities or other functionality does not take a communications jack outside of the scope of the present invention or the claims appended hereto.

While the present invention has been described above primarily with reference to the accompanying drawings, it will be appreciated that the invention is not limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

As discussed above, embodiments of the present invention are directed to communications jacks. As used above, the terms "forward" and "front" and derivatives thereof refer to the direction defined by a vector extending from the center of the jack toward the plug aperture of the jack. Conversely, the term "rearward" and derivatives thereof refer to the direction directly opposite the forward direction. Together, the forward and rearward directions define the "longitudinal" dimension of the jack. The term "transverse" and derivatives thereof refer to the direction generally parallel with the line defined by the side of the plug aperture that includes a cutout for the latch of a mating plug and extending away from a plane that longitudinally bisects the center of the jack. A line normal to the longitudinal and transverse dimensions defines the "vertical" dimension of the jack. These dimensions are illustrated graphically in FIG. 3A.

Spatially relative terms, such as "under", "below", "lower", "over", "upper", "top", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, operations, elements, and/or components, but do not preclude the presence or addition of one or more other features, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Herein, the terms "attached", "connected", "interconnected", "contacting", "mounted" and the like can mean either direct or indirect attachment or contact between elements, unless stated otherwise.

Features of the different embodiments described herein may be combined in any way to provide a plurality of additional embodiments.

Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A communications jack, comprising:

a housing having a plug aperture in a front portion thereof;

a plurality of spring members that extend into the plug aperture;

a plurality of plug contacts that are mounted on and physically attached to respective ones of the spring members, each of the plug contacts including an upper surface that is configured to engage a respective blade of a mating communications plug and a flange extending downwardly from the upper surface; and a plurality of fixed contacts, wherein each fixed contact is configured to be in electrical contact with a respective one of the plug contacts when a plug is received within the plug aperture, wherein the spring members are not part of a communications path through the communications jack.

2. The communications jack of claim 1, further comprising a printed circuit board that is mounted at least partly within the housing, wherein each of the fixed contacts is mounted in or on the printed circuit board.

3. The communications jack of claim 2, wherein each of the fixed contacts comprises a base portion that is mounted in an opening in the printed circuit board and at least one protruding member that extends above a top surface of the printed circuit board.

4. The communications jack of claim 2, wherein each of the fixed contacts comprises an aperture in the printed circuit board that has a sidewall that is at least partly covered with a conductive material, and wherein each of the plug contacts includes a downwardly extending member that engages the conductive material in the respective apertures.

5. The communications jack of claim 1, wherein each of the spring members comprises an elongated member formed of a resilient metal that is at least partly coated with an insulative material that electrically isolates the spring members from the respective plug contacts mounted thereon.

6. The communications jack of claim 1, wherein each of the plug contacts includes at least one downwardly extending member that is configured to slide downwardly along a respective one of the fixed contacts in response to a mating plug being received within the plug aperture in order to maintain a mechanical and electrical connection to the fixed contact.

7. The communications jack of claim 2, wherein each of the fixed contacts includes an eye-of-the-needle termination that is mounted in a respective aperture in the printed circuit board.

8. The communications jack of claim 1, wherein each of the plug contacts has the same shape, and wherein at least one of the plug contacts is mounted in an orientation that is about 180 degrees rotated from the orientation of another of the plug contacts.

9. The communications jack of claim 5, wherein the spring members are mounted so as to inject a compensating crosstalk signal on at least one of a plurality of differential pairs of communications channels that run through the communications jack.

10. The communications jack of claim 2, further comprising:

a plurality of conductive paths on the printed circuit board, each of which is electrically connected to a respective one of the fixed contacts; and a plurality of output contact mounting structures on or in the printed circuit board that are electrically connected to respective ones of the conductive paths on the printed circuit board.

11. The communications jack of claim 2, further comprising a spring holder that is mounted on the printed circuit board that mounts the spring members to extend in cantilever fashion above a top surface of the printed circuit board.

12. The communications jack of claim 2, wherein a first of the fixed contacts comprises first and second members that protrude above the printed circuit board that are electrically connected to a first of the plug contacts, wherein the first member is part of a signal current carrying path between the first of the plug contacts and an output of the jack and the second member electrically connects a crosstalk compensation circuit to the first of the plug contacts.

13. A communications jack, comprising:

a housing having a plug aperture in a front portion thereof;

a plurality of spring members that extend into the plug aperture;

a plurality of plug contacts that are mounted on respective ones of the spring members;

a plurality of fixed contacts, wherein each fixed contact is configured to be in electrical contact with a respective one of the plug contacts when a plug is received within the plug aperture, wherein each plug contact includes a downwardly extending member, and wherein the downwardly extending member of a first of the plug contacts is offset in a longitudinal direction of the jack from the downwardly extending member of a second plug contact that is directly adjacent to the first plug contact.

14. A communications jack, comprising:

a housing having a plug aperture in a front portion thereof;

a plurality of spring members that extend into the plug aperture;

a plurality of plug contacts that are mounted on respective ones of the spring members; and a plurality of fixed contacts, wherein each fixed contact is configured to be in electrical contact with a respective one of the plug contacts when a plug is received within the plug aperture, wherein each spring member is electrically isolated from the respective one of the plug contacts mounted thereon by an insulating material that is coated on each spring member.

15. A communications jack, comprising:

a housing having a plug aperture that is configured to receive a mating communications plug;

a spring member that extends into the plug aperture;

first and second conductive plug contacts that are separate from the spring member, wherein the first conductive plug contact is mounted on the spring member to move upwardly and downwardly with the spring member relative to the housing;

a printed circuit board that is at least partly mounted within the housing; and an output contact that is electrically connected to the first conductive plug contact by a conductive path on the printed circuit board, wherein the first and second plug contacts are configured to receive a differential communications signal, and wherein the first plug contact includes a downwardly extending member that is configured to physically contact the output contact.

16. The communications jack of claim 15, wherein the conductive plug contact includes an upper surface that is configured to engage the blade of a mating plug and at least one downwardly extending flange.

17. The communications jack of claim 15, further comprising:

a printed circuit board that is at least partly mounted within the housing underneath the spring member; and a printed circuit board mounted contact that is configured to be mate with the conductive plug contact.

18. The communications jack of claim 15, wherein the spring member is electrically isolated from the conductive plug contact.

19. A communications jack, comprising:

a housing having a plug aperture;

a spring member that extends into the plug aperture;

a conductive plug contact that is separate from the spring member and that is mounted on the spring member to move upwardly and downwardly with the spring member relative to the housing a printed circuit board that is at least partly mounted within the housing underneath the spring member; and a printed circuit board mounted contact that is configured to mate with the conductive plug contact, wherein the conductive plug contact is a sliding contact that is configured to slide along a surface of the printed circuit board mounted contact.

20. A contact for an RJ-45 jack, comprising:

a spring member;

a plug contact that is electrically insulated from the spring member and that is mounted on the spring member, the plug contact having an upper surface that is configured to mate with a blade of a mating RJ-45 plug, opposed side surfaces and at least one flange that extends downwardly from the upper surface, wherein the spring member extends through a channel defined by the upper surface of the plug contact and the opposed side surfaces of the plug contact.

21. The RJ-45 contact of claim 20, wherein the spring member is electrically isolated from the plug contact.

* * * * *

UNITED STATES PATENT AND TRADEMARK OFFICE

CERTIFICATE OF CORRECTION

PATENT NO. : 9,281,622 B2
APPLICATION NO. : 14/084991
DATED : March 8, 2016
INVENTOR(S) : Fitzpatrick It is certified that error appears in the above-identified patent and that said Letters Patent is hereby corrected as shown below:

In the Claims:

Column 15, Claim 17, Line 24: Please delete the word "be" so the line will read
-- to mate with the conductive plug contact. --

Signed and Sealed this
Fourteenth Day of June, 2016

Michelle K. Lee

Michelle K. Lee
*Director of the United States Patent and Trademark Office*